US011346140B2

(12) United States Patent
Royse et al.

(10) Patent No.: US 11,346,140 B2
(45) Date of Patent: May 31, 2022

(54) SAFETY BRAKE FOR VERTICAL LIFTING DOORS

(71) Applicant: Renlita Doors North America, LLC, Bonham, TX (US)

(72) Inventors: Jason Royse, Bonham, TX (US); Caleb Allan White, McKinney, TX (US)

(73) Assignee: Renlita Doors North America, LLC, Bonham, TX (US)

( * ) Notice: Subject to any disclaimer, the term of this patent is extended or adjusted under 35 U.S.C. 154(b) by 441 days.

(21) Appl. No.: 16/258,713

(22) Filed: Jan. 28, 2019

(65) Prior Publication Data

US 2019/0153760 A1 May 23, 2019

Related U.S. Application Data

(63) Continuation of application No. PCT/US2017/044196, filed on Jul. 27, 2017.

(60) Provisional application No. 62/367,721, filed on Jul. 28, 2016.

(51) Int. Cl.

| | |
|---|---|
| ***E05D 13/00*** | (2006.01) |
| ***E05D 15/16*** | (2006.01) |
| ***B66B 13/26*** | (2006.01) |

(52) U.S. Cl.

CPC ..... *E05D 13/145* (2013.01); *B66B 13/26* (2013.01); *E05D 13/00* (2013.01); *E05D 13/003* (2013.01); *E05D 13/1238* (2013.01); *E05D 13/14* (2013.01); *E05D 15/16* (2013.01); *E05Y 2201/246* (2013.01); *E05Y 2201/50* (2013.01); *E05Y 2800/252* (2013.01)

(58) Field of Classification Search

CPC ..... E05D 13/003; E05D 13/006; E05D 13/14; E05D 13/145; E05D 13/1238; E05D 15/16

USPC ..... 49/322

See application file for complete search history.

(56) References Cited

U.S. PATENT DOCUMENTS 2,238,963 A * 4/1941 Bayer ..... E05D 13/14 49/322

4,696,375 A * 9/1987 Matthews ..... B66B 13/06 187/313

4,854,077 A 8/1989 Rogers et al.

(Continued)

FOREIGN PATENT DOCUMENTS

WO WO 1999/040282 A1 8/1999

OTHER PUBLICATIONS

DE 29808661 U1 and machine translation provided in PCT/US2017/044196 International Search Report and Written Opinion dated Oct. 5, 2017 (43 pages).

(Continued)

*Primary Examiner* — Gregory J Strimbu

(74) *Attorney, Agent, or Firm* — Ferguson Braswell Fraser Kubasta PC; Elizabeth Philip Dahm; John M. Cone

(57) ABSTRACT

A vertical door system includes a safety brake that is engaged when the vertical door system fails. The safety brake includes a panel with a slanted channel and a pin slidably disposed in the slanted channel. The panel may be coupled to a counterweight that keeps the pin from engaging with stops in a track when the safety brake is disengaged. When the panel is uncoupled from the counterweight, the safety brake engages and the pin may slide in the channel to allow contact between a portion of the pin and one of the stops in the track to inhibit movement of a door.

19 Claims, 7 Drawing Sheets

(56) References Cited

U.S. PATENT DOCUMENTS

| | | | | |
|---|---|---|---|---|
| 9,243,435 | B1 | 1/2016 | Kaounas | |
| 9,487,987 | B2 * | 11/2016 | Baczweski | E05F 15/686 |
| 9,856,112 | B1 * | 1/2018 | Cirone | B66B 5/26 |
| 2005/0016797 | A1 * | 1/2005 | Reynolds | B66B 13/06 187/340 |
| 2012/0186158 | A1 * | 7/2012 | Sanke | E05D 13/006 49/322 |

OTHER PUBLICATIONS

FR 2384091 and machine translation provided in PCT/US2017/044196 International Search Report and Written Opinion dated Oct. 5, 2017 (43 pages).

* cited by examiner

SAFETY BRAKE FOR VERTICAL LIFTING DOORS

CROSS-REFERENCE TO RELATED APPLICATION

This application is a continuation of International Patent Application No. PCT/US17/44196 entitled "SAFETY BRAKE FOR VERTICAL LIFTING DOORS" and filed on Jul. 27, 2017, which claims the benefit of U.S. Provisional Patent Application No. 62/367,721 entitled "SAFETY BRAKE FOR VERTICAL LIFTING DOORS", filed on Jul. 28, 2016, both of which are hereby incorporated by reference in its entirety.

TECHNICAL FIELD

The present invention relates to safety brakes for vertical doors.

BACKGROUND

Vertical doors are doors that are opened by lifting a door approximately vertically and closed by pulling a door down approximately vertically. For example, the vertical door may be lifted vertically, wrapped in sections (e.g., in a sectioned door) around a top member, collapsed in sections that slide up, and/or lifted up and perpendicular (e.g., to be approximately perpendicular to a closed door position). Vertical doors are commonly operated using a system of counterweights that assist in opening and closing the vertical doors. The counterweights may reduce the energy required to adjust the vertical door position, and thus operational costs. However, when the vertical door system fails (e.g., when cable(s) moving the vertical door breaks), the counterweights may quickly and unsafely alter the position of the vertical door. For example, commonly, the vertical door may fall down (e.g., closed position) when the vertical door system fails causing a dangerous situation for objects and/or persons in the path of the falling door.

SUMMARY

In various implementations, an emergency brake may be provided in a vertical door system. The vertical door system may include a door coupled to a movement member. The door may be disposed in a track at a location.

In some implementations, the vertical door system may include a safety brake. The safety brake may engage when the vertical door system fails (e.g., cable supporting and/or adjusting door position breaks). The safety brake may include a panel with a slanted channel and a pin slidably disposed in the slanted channel. The panel may be coupled to a counterweight that keeps the pin from engaging with stops in the track when the safety brake is disengaged. When the panel is uncoupled from the counterweight (e.g., due to failure of the movement system), the safety brake may be engaged and the pin may slide through the channel to allow contact between a portion of the pin and a stop in the track. By contacting the stop in the track, the movement of the door may be inhibited (e.g., since the pin will contact stops in the track, the movement of the door may be restricted to the area between adjacent stops of the track). Inhibiting movement of the door (e.g., free fall of the door) when the movement member fails may increase operational safety.

In various implementations, a safety brake of a vertical door may include a panel with a slanted channel and a pin at least partially disposed in the slanted channel. The safety brake may include a first end and an opposing second end. The panel may include a first end and a second opposing end. A counterweight of a vertical door may be coupled proximate a first end of the panel and/or a first end of a safety brake. A first end of a spring may be coupled proximate a second end of the panel. The second opposing end of the spring may be coupled to proximate second end of the safety brake. When the safety brake is disengaged, the pin may be disposed in the slanted channel such that the pin may be inhibited from contacting a stop in a track, in which the door of the vertical door is disposed. For example, the counterweight may exert a force on the panel to extend the spring coupled to the panel. Thus, the pin in the slotted channel may be subject to a force in the direction of the first end of the panel and counterweight to cause the pin to slide away from stops in the track. When the safety brake is engaged (e.g., due to failure of the movement member), the pin may be disposed in the slanted channel such that the pin is capable of contacting a stop in the track. For example, failure of the movement member may cause the counterweight to be uncoupled from the safety brake and thus the panel of the safety brake. The spring coupled to the panel may then be released from the force causing the spring to extend and the spring may return to an unextended position (e.g., in compression or not in compression). The force of the spring being released from the extended position may cause the pin to slide towards the stops in the track and/or retain the pin in the position in which it is capable of contacting a stop in the track. By contacting a stop in the track, the door of the vertical door may be inhibited from moving (e.g., further falling due to uncoupling from the counterweight may be inhibited).

Implementations may include one or more of the following features. The safety brake may be included in a vertical door system. The vertical door system may include a door, a movement member to adjust the position of the door, and the safety brake. The safety brake may be coupled to the door (e.g., via door coupler).

In various implementations, a safety brake may include a housing and a panel disposed in the housing. The panel may be moveable within the housing. The panel may include a first end coupled to a counterweight of a movement coupled to a vertical door, and an opposing second end. The first end of the panel may be proximate the first end of the housing and the second end of the panel may be proximate the second end of the housing. The panel may include a first side disposed between the first end and the second end of the panel and a second side disposed between the first end and the second end and disposed on an opposite the first side. The panel may include a slanted channel extending from the first side to the second side and a pin may be disposed at least partially in the slanted channel of the panel. The panel may include coupling member capable of coupling to vertical door. The safety brake may include a spring with a first end coupled to the second end of the panel. The second opposing end of the spring may be coupled to the housing proximate an end of the housing. The safety brake may engage with a stop in a track in which the safety brake is disposed when the counterweight is uncoupled from the panel (e.g., a cable coupling the counterweight and the safety brake is broken). When the counterweight is uncoupled from the panel, the spring of the safety brake compresses and causes the pin to extend further from the first side of the panel to engage the stop of the track. Engaging the stop in the track inhibits the vertical door coupled to the safety brake from falling (e.g., falling further since the vertical door is supported and inhibited from moving by the pin engaging the stop).

Implementations may include one or more of the following features. The panel may be coupled to the counterweight via a cable indirectly coupled to the panel. The slanted channel may extend upwards as it extends from the first side of the panel to the second side of the panel. At least one end of a pin may include a head. The head may capable of catching the pin on a stop of a track in which the safety brake is disposed. The head may include a cap, a flange, and/or a protrusion. The head of the pin may be disposed on an opposing side of the panel as the side to which the door is coupled to the safety brake. The pin may include a length and a uniform or non-uniform cross-section across the length. The pin may include a first cam surface proximate a first end of the pin. The first cam surface may extend along at least a portion of the length of the pin. The pin may include a second cam surface proximate an opposing second end of the pin. The second cam surface may extend along at least a portion of the length of the pin. The first cam surface may be similar to a first inner surface of the slanted channel and the second cam surface may be similar to a second inner surface of the slanted channel, in some implementations. The first cam surface may be disposed in a first recess of the pin such that the first cam surface is capable of contacting a first inner surface of the slanted channel. The second cam surface may be disposed in a second recess of the pin such that the second cam surface is capable of contacting a second inner surface of the slanted channel. The first cam surface and the second cam surface may include slanted surfaces. The track may include a plurality of stops and a pin of the safety brake may be inhibited from contacting the plurality of stops when the safety brake is disengaged. The coupling member may include an opening adapted to receive a door coupler, wherein the door coupler couples the vertical door to the safety brake.

In various implementations, a vertical door system may include a door disposed on a track, a movement, and one or more safety brakes. The track comprises one or more stops (e.g., to inhibit movement of the door when the safety brake engages a stop). The movement (e.g., automatic and/or manual) may be coupled to the door and capable of adjusting a position of the door. The movement may include a counterweight. A safety brakes may include a housing and a panel disposed in the housing and moveable within the housing. The panel may include a first end coupled to a counterweight and an opposing second end. The panel may include a first side disposed between the first end and the second end of the panel and a second side disposed between the first end and the second end and disposed on an opposite the first side. The panel may include a slanted channel extending from the first side to the second side. The panel may include a door coupler, which couples (e.g., directly or indirectly) the door and the panel. The safety brake may include a pin disposed at least partially in the slanted channel of the panel and a spring. The spring may include a first end coupled to the opposing second end of the panel, and an opposing second end that is coupled to the housing proximate an end of the housing. The one or more safety brakes are configured to engage with at least one of the stops in the track when the counterweight is uncoupled from the panel of the one or more safety brakes. When the counterweight is uncoupled from the panel of at least one of the safety brakes, the spring of the at least one safety brake compresses and causes the pin of the at least one safety brake to extend further from the first side of the panel of the at least one safety brake and engage at least one of the stops. By engaging at least one of the stops in the track, the safety brake inhibits the door from falling.

Implementations may include one or more of the following features. The movement may operate manually and/or automatically. The counterweight may include more than one counterweight member. The door may include door panels and/or sub doors.

In various implementations, a vertical door may be stopped from falling (e.g., all the way to the ground more than the distance between two stops in a track, greater than a predetermined distance, etc.) by engagement of a safety brake. One or more safety brakes coupled to a vertical door may be provided. The vertical door may be disposed in a track and the track may include one or more stops. The safety brakes may include a panel moveable in a housing. The panel of the safety brake may include a first end coupled to a movement and proximate a first end of the housing, and an opposing second end proximate a second end of the housing. The movement may be coupled to the vertical door (e.g., to adjust the position of the door between two or more positions). The panel of the safety brake may include a slanted channel extending through the panel. A pin may be disposed in the channel such the pin does not contact the one or more stops in the track when the safety brake is disengaged. The pin may be disposed in the channel such that the pin contacts at least one of the stops when the safety brake is engaged. The safety brake may include a spring coupled to the second end of the panel and an end of the housing. At least one of the safety brakes may be automatically engaged to inhibit the vertical door from falling (e.g., when the movement is broken). A safety brakes may be automatically engaged when a counterweight of a movement coupled to the vertical door is uncoupled from the safety brake. Uncoupling the counterweight may allow the spring of the safety brake to compress and move the panel coupled to the spring towards the second end of the housing. Movement of the panel of the safety brake by the compression of the spring causes the pin in the panel to extend such that the pin is capable of contacting at least one of the stops in the track. When a movement fails (e.g., counterweight is uncoupled from the safety brake), one or more of the safety brakes may be engaged.

Implementations may include one or more of the following features. Adjustment of the vertical door may be allowed via a movement when each of the one or more safety brakes are disengaged. When a safety brakes is disengaged, a counterweight of the movement coupled to the first end of the panel of the safety brake exerts a force on the spring to cause the spring to extend. Extending the spring may cause the panel of the safety brake to move towards the first end of the housing and the pin to be disposed such that the pin does not contact the one or more stops in the track. In some implementations, one or more slanted surfaces of the slanted channel may exert a force on one or more slanted surfaces of the pin to cause the position of the pin in the slanted channel to adjust as the panel is moved between the first end of the housing and the second end of the housing. The stop and one or more of the safety brakes may be capable of supporting the door when at least one of the safety brakes is engaged. A pin head of the safety brake may contact at least one stop in the track, when the safety brakes is engaged.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which:

FIG. 1C illustrates an implementation of the example door system 100 illustrated in FIG. 1A in which the counterweight includes more than one counterweight.

Like reference symbols in the various drawings indicate like elements.

DETAILED DESCRIPTION

Vertical doors may be utilized in a variety of applications. For example, storefront openings, storage areas, garages, warehouses, and a variety of other structures may include vertical doors that open and close. The vertical door may be disposed in a location such that the door is positioned approximately vertically (e.g., approximately normal to a surface of a ground, flooring, or other area proximate where the door rests in a closed position, etc.), in some implementations.

Figure 1A:
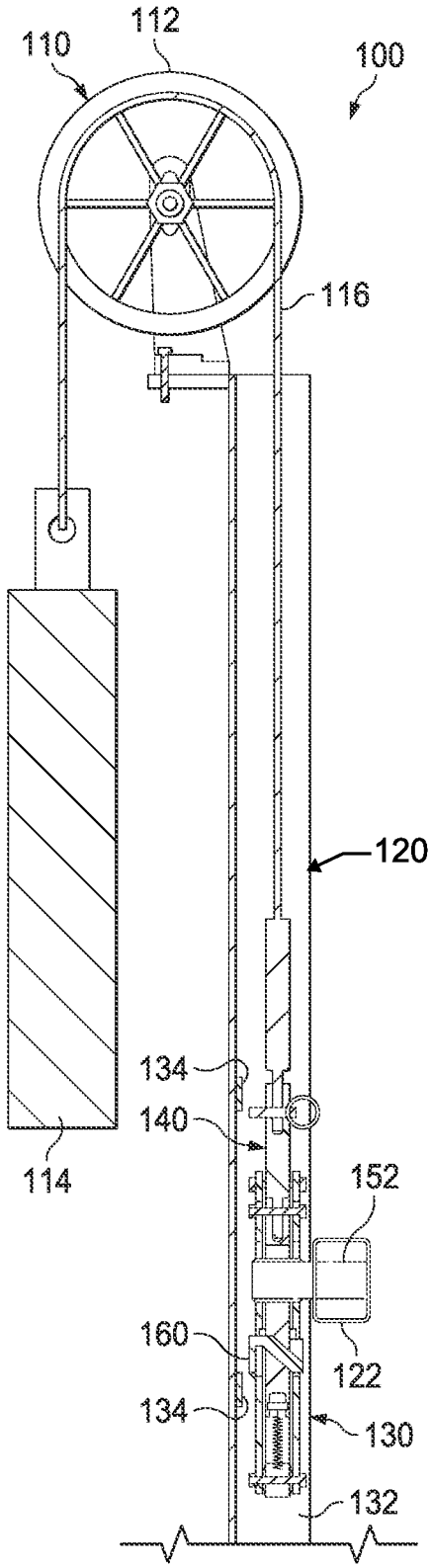
FIG. 1A illustrates a cross-sectional view of an implementation of an example vertical door system in which the safety brake is disengaged.
Figure 1B:
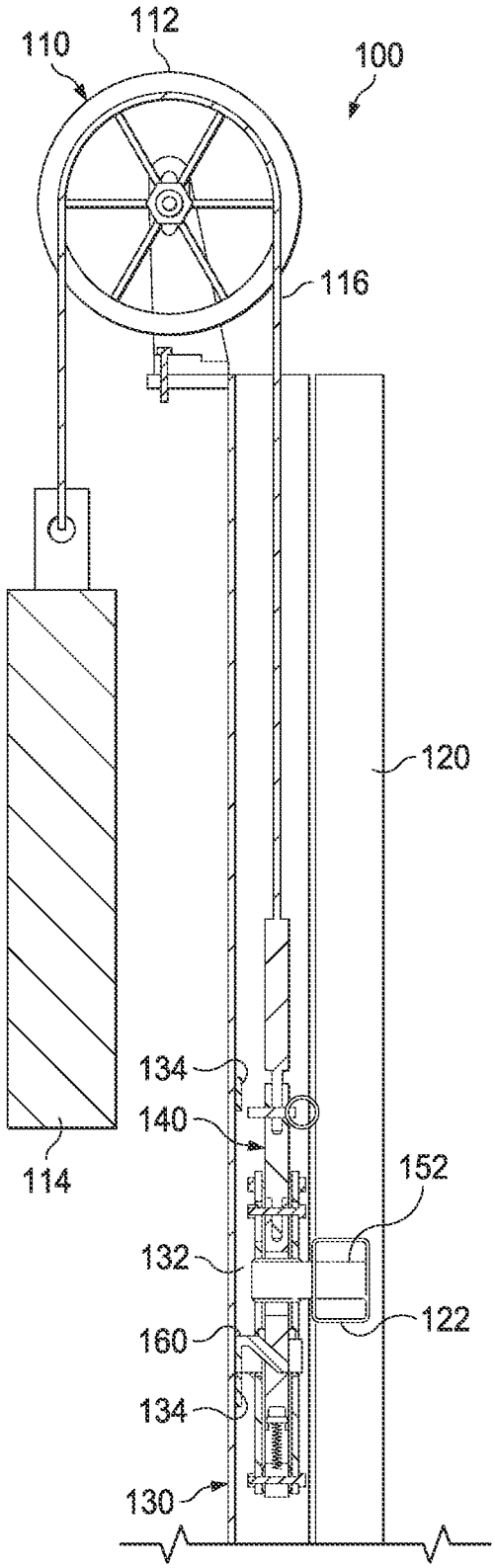
FIG. 1B illustrates a cross-sectional view of an implementation of an example vertical door system in which the safety brake is engaged.
Figure 1C:
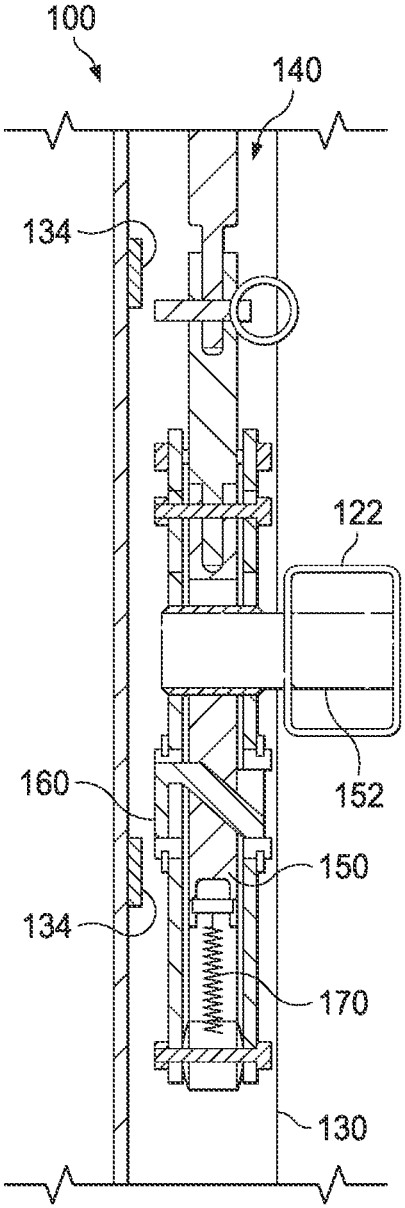
FIG. 1C illustrates a cross-sectional view of an implementation of a portion of the example vertical door system illustrated in FIG. 1A.

FIGS. 1A and 1B illustrate implementations of example vertical door system 100. FIG. 1C illustrates an implementation of the example door system 100 illustrated in FIG. 1A in which the counterweight includes more than one counterweight 114*a*, 114*b*, 114*c*. A vertical door system 100 may include a movement member 110 and a door 120. The door 120 may include a frame 122. The frame of the door may extend from side(s) of the door. The frame may include bushings proximate ends of the frame. The frame of the door may include any appropriate material such as steel, aluminum, composite materials (e.g., fiber reinforced plastics), combinations thereof, and/or any other appropriate material. The frame may facilitate connection with components of the vertical door system and/or provide structural support to the door. The door may include one or more panels, openings, windows, slats, mesh, bars, additional sub doors (e.g., a secondary door mounted in the door) and/or any other appropriate component. The door may be a single member door, sectional door, and/or any other appropriate door.

During operation of the vertical door system, the door may be moved between two or more positions. The door may be disposed in a closed position when the door is proximate a ground of a location. For example, in a closed position, the door may restrict access to an area behind a door, such as a store, a storage space, etc. The door may be disposed in an open position when the door is lifted to a predetermined open position. In some implementations, the door may be disposed in more or more intermediate positions disposed between the open and closed positions.

In some implementations, the door 120 may be disposed on a track 130. The track 130 may include a path (e.g., a recess) 132 along which the door may travel. For example, the frame 122 of the door 120 may include bushings that travel in the path 132 of the track 130 when the door moves. The track may include stops 134 disposed along at least a portion of a height of the track. The stops may be evenly or unevenly spaced along the length of the track. The stops may be any appropriate size and/or shape. The size and/or shape of the stop may be selected such that the safety brake contacts stop(s) in the track when the safety brake is engaged and the safety brake does not contact stop(s) in the track when the safety brake is disengaged. The stop may have a strength to support and/or support in conjunction with other stops (e.g., on an opposing side of the door for example) the weight of the door and/or other components of the vertical door coupled to the door, when the brake is engaged and the safety brake contacts the stop.

The movement member 110 of the vertical door system may adjust the position of the door in relation to a track in which the door is mounted. For example, at a location, a track may be coupled to a structure of the location and/or a freestanding track may be coupled to the location. The door 120 may be mounted in the track 130. The movement member 110 may be coupled to the door 120 (e.g., door or portions thereof, such as the frame) and adjust the position of the door along a length of the track 130.

The movement member 110 may operate automatically and/or manually. For example, a power source and a motor may be coupled to the pulley of the movement member to apply power to lift and/or lower the door. In some implementations, the vertical door may be operated manually (e.g., a user may push and/or pull the door and/or a member coupled to the door to adjust the position).

In some implementations, the movement member 110 may include pulley(s) 112, counterweight(s) 114, and cable(s) 116. The movement member 110 may couple to the door 120 via a cable 116. The cable 116 may couple proximate a first end of the cable (e.g., directly or indirectly) to the door 120 of the vertical door system and couple proximate a second opposing end of the cable (e.g., directly or indirectly) to the counterweight 114. In some implementations, the cable may couple to the door via a safety brake of the vertical door. The cable may travel on a path of the pulley to allow movement of the door.

Figure 2C:
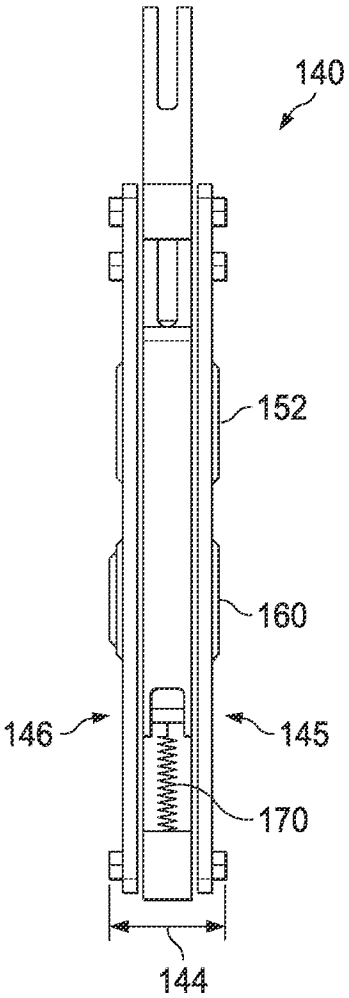
FIG. 2C illustrates a side view of an implementation of the example safety brake illustrated in FIG. 2A.
Figure 2B:
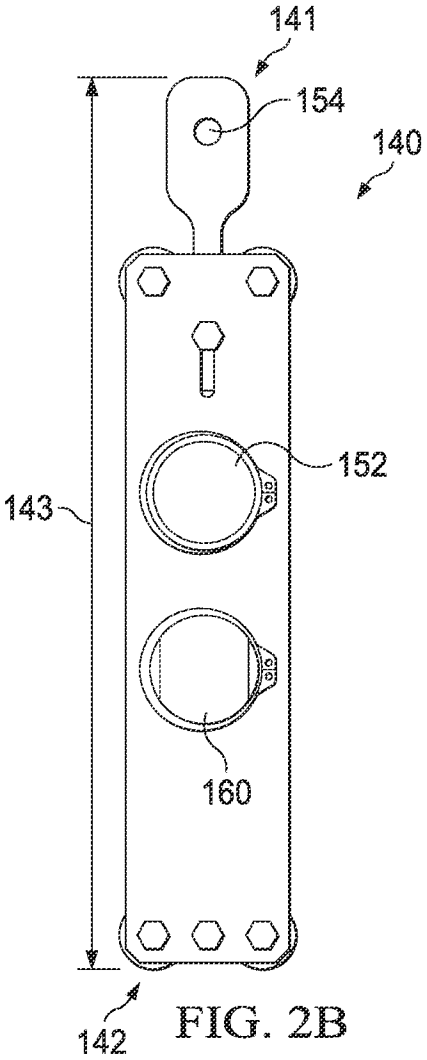
FIG. 2B illustrates a front view of an implementation of the example safety brake illustrated in FIG. 2A.
Figure 2A:
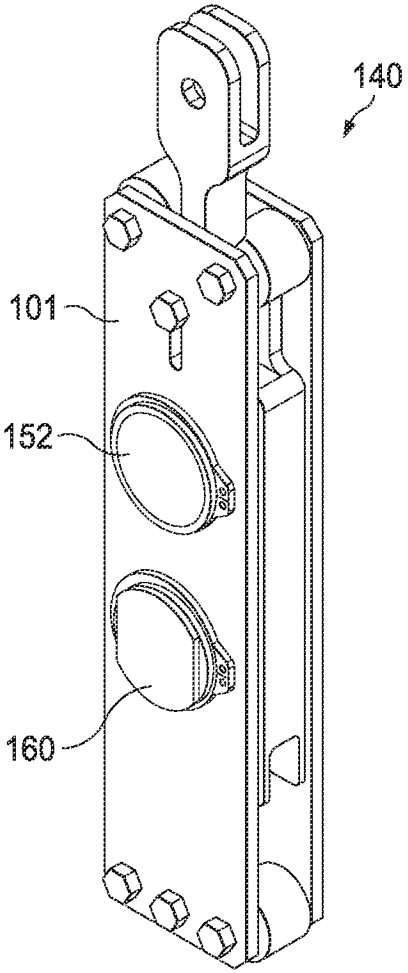
FIG. 2A illustrates a perspective view of an implementation of an example safety brake.
Figure 2D:
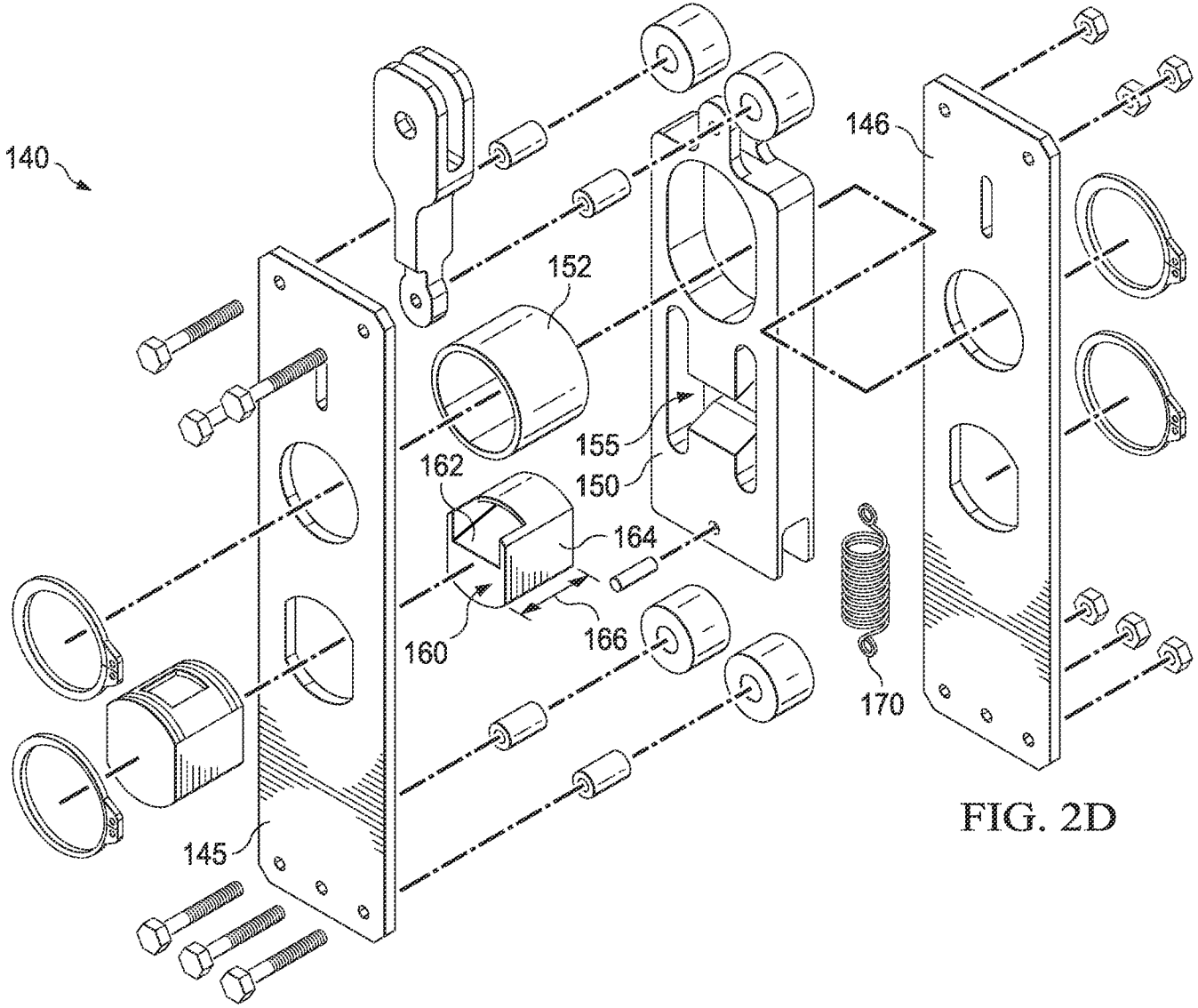
FIG. 2D illustrates an exploded view of an implementation of the example safety brake illustrated in FIG. 2A.

In various implementations, the vertical door system 100 may include a safety brake 140. FIGS. 2A-2C illustrate an implementation of an example safety brake. FIG. 2D illustrates an exploded view of the example safety brake illustrated in FIGS. 2A-2C.

Figure 1D:
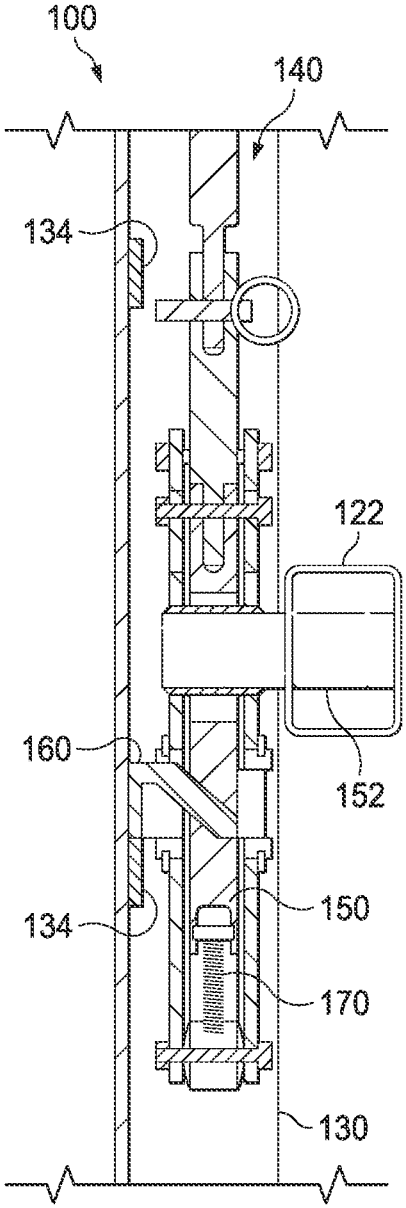
FIG. 1D illustrates a cross-sectional view of an implementation of a portion of the example vertical door system illustrated in FIG. 1B.
Figure 1E:
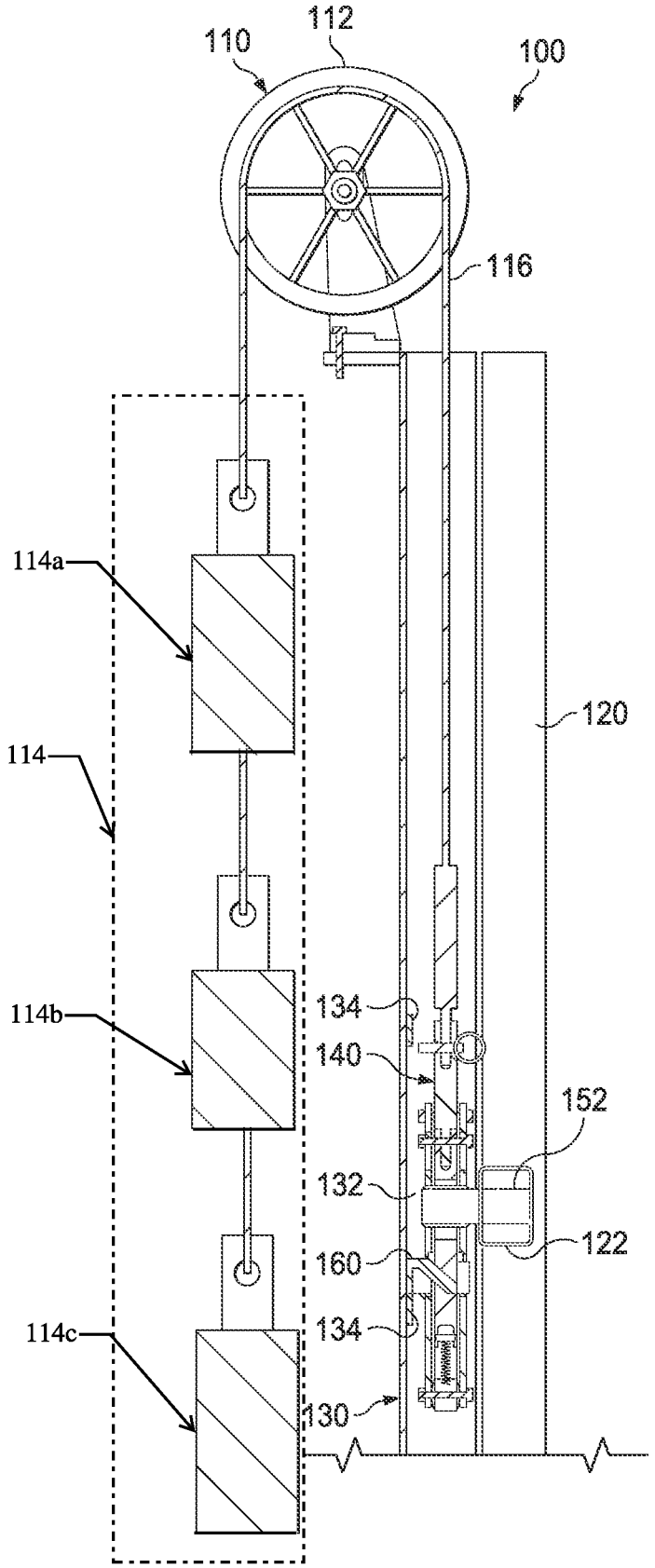

The safety brake 140 may be engaged to inhibit movement of the door and disengaged to allow movement of the door. FIGS. 1A and 1C illustrate an implementation of a disengaged safety brake and FIGS. 1B and 1D illustrate an implementation of an engaged safety brake. For example, if the movement member of the vertical door fails, the safety brake may be engaged to inhibit the vertical door from falling (e.g., to a closed position). A falling vertical door (e.g., due to failure of the movement member or portions thereof) may present a safety hazard to objects and/or person(s) proximate the path of the door. In some implementations, a free falling door, due to failure of the movement member, may damage the door and/or the track. Thus, a safety brake may be included in a vertical door system.

The safety brake 140 may include a housing 101. The housing 101 may include a first end 141 and a second opposing end 142. In some implementations, the housing, and thus the door, may be coupled to the counterweight via a cable proximate the first end 141 of the housing. As illustrated, the first end 141 of the housing may include an opening 154 through which the cable is coupled (e.g., directly or indirectly). The housing may have a height 143 (e.g., that extends between the first end 141 and the second end 142), a depth 144, and a width. The housing may include a first side 145 and an opposing second side 146.

A panel 150 and a door coupler 152 may be disposed in the housing. The door coupler 152 may couple the door (e.g., the frame of the door) and the safety brake 140. The door coupler may be disposed at least partially through the door and at least partially through the panel, and thus the housing, of the safety brake. The door coupler may include any appropriate fastener.

The panel 150 may be moveable within the housing. The panel 150 may be coupled at a first end to the counterweight 114 and coupled at an opposing second end to a spring 170. The spring 170 may be coupled (e.g., fastened, bonded, etc.) to a second end 142 of the housing. For example, a fastener may couple an opening in the panel and an opening in the spring. During normal operations (e.g., when the safety brake is disengaged), the counter weight may exert a force on the panel and extend the spring. When the safety brake is engaged (e.g., emergency operation), the counterweight may be uncoupled from the safety brake and thus the panel (e.g., due to broken cable in the movement member) and the spring may be allowed to compress (e.g., to a resting position) since the force of the counterweight has been removed. Thus, the panel may move closer to the second end of the housing when the safety brake is engaged.

Figure 2E:
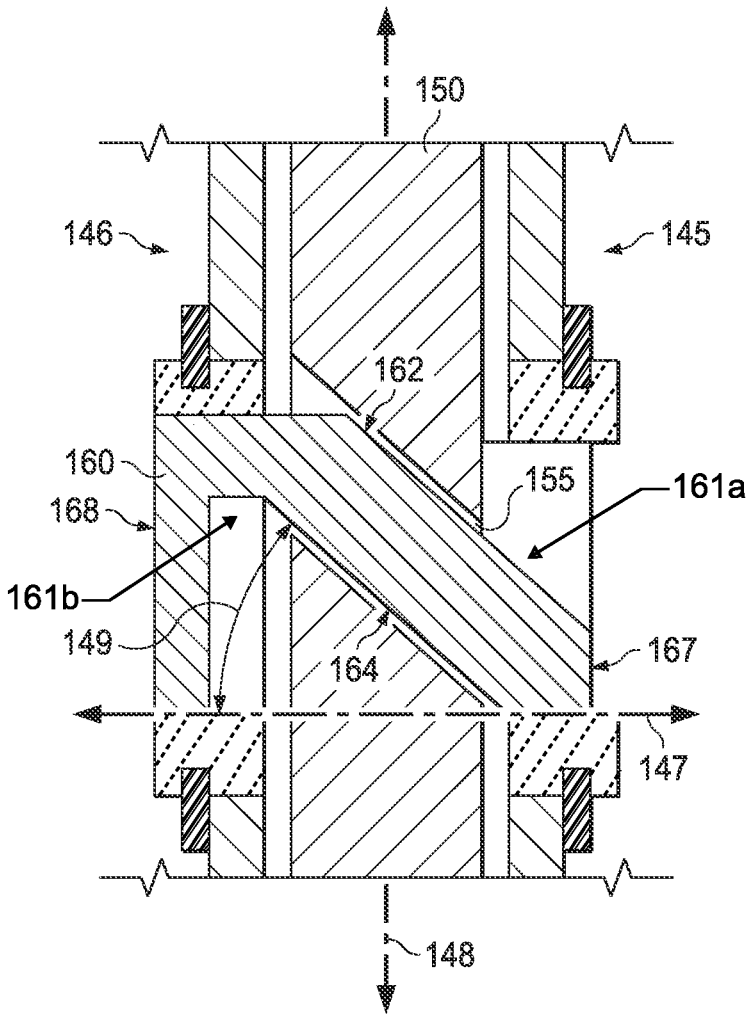
FIG. 2E illustrates a cross-sectional view of an implementation of a portion of the example safety brake illustrated in FIG. 2A.

The panel 150 of the safety brake 140 may include a slanted channel 155 and a pin 160 disposed in the slanted channel. The slanted channel 155 may be a recess disposed through the panel 150 of the safety brake 140. The recess of the slanted channel 155 is slanted with respect to the height 143 and the depth 144 of the safety brake 140. FIG. 2E illustrates an implementation of an example portion of a safety brake. As illustrated, a first axis 147 may be defined along a height of the first side 145 of the housing and parallel to the height of the second side 146 of the housing. A second axis 148 may be defined perpendicular to the height of the first side 145 and the height of the second side 146 of the housing. The slanted channel 155 may slant at a first angle 149 from the first axis 147, where the first angle is between 0 and 90 degrees. For example, the first angle may be approximately 30 degrees to approximately 70 degrees, in some implementations. The first angle may be approximately 45 degrees in some implementations. The slanted channel may slant at a second angle between 90 and 180 degrees from the second axis. As illustrated, the slanted channel 155 may extend upwards, relative to the illustration orientation, as it extends from the first side 145 to the second side 146.

Figure 3A:
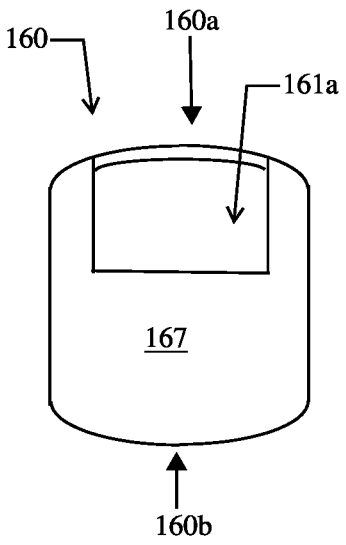
FIG. 3A illustrates a front view of an implementation of the example pin of the example safety brake, a portion of which is illustrated in FIGS. 2D and 2E.
Figure 3B:
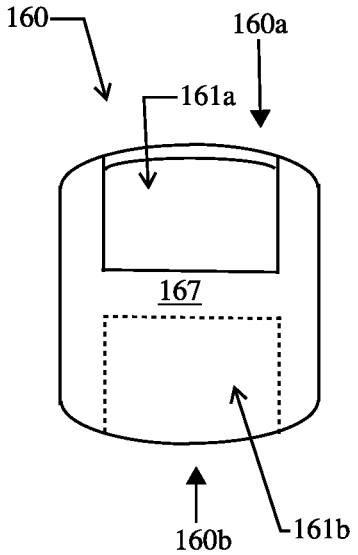
FIG. 3B illustrates the front view of the implementation of the example pin illustrated in FIG. 3A, in which the second recess is shown.
Figure 3C:
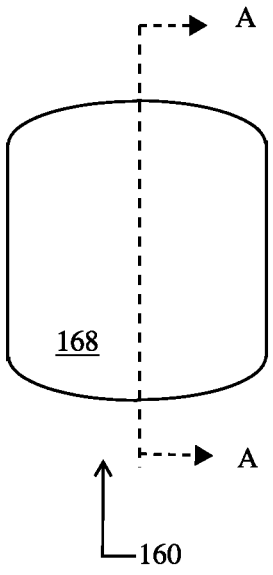
FIG. 3C illustrates a back view of the implementation of the example pin illustrated in FIG. 3A.
Figure 3D:
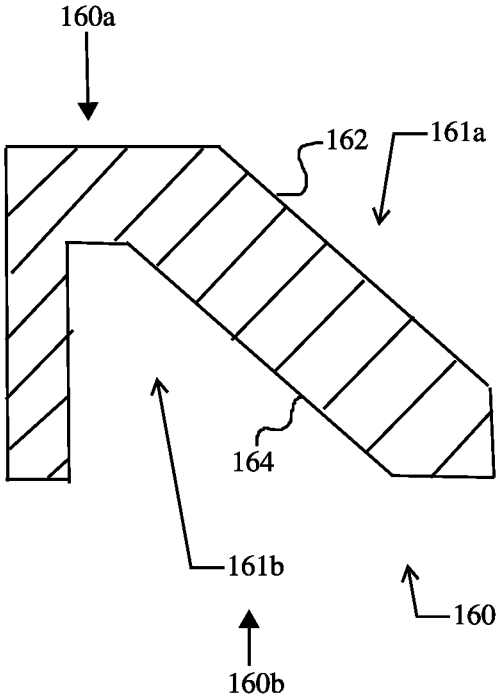
FIG. 3D illustrates a cross-sectional view of the implementation of the example pin illustrated in FIG. 3C.

A pin 160 may be slidably disposed in the slanted channel 155 of the safety brake 140. The pin 160 may extend through the slanted channel 155 and the housing of the safety brake 140. In some implementations, the pin may include a head to inhibit the pin from traveling all the way through the slanted channel and/or to facilitate catching the pin on a stop of the track. The pin 160 may include a first cam surface 162 on a first side 160*a* of the pin and a second cam surface 164 on a second opposing side 160*b* of the pin. As illustrated, the first cam surface 162 may be disposed on an upper first side of the pin, relative to the illustration orientation, and the second cam surface 164 may be disposed on a lower opposing second side of the pin, relative to the illustration orientation. FIGS. 3A and 3B illustrate a front view of the first end 167 of the pin 160. FIG. 3C illustrates the second end 168 of pin 160. FIG. 3D illustrates a cross-sectional view along section A-A illustrated in FIG. 3C.

In some implementations, an angle of the cam surface may be similar or different from the angle of the slanted channel surface engaged by the cam surface. For example, as illustrated a first cam surface may be disposed on an upper side of the pin (e.g., relative to the illustration orientation) and may have a similar angle to the upper side (e.g., relative to the illustration orientation) of the inner surface of the slanted channel. A second cam surface may be disposed on a lower side of the pin (e.g., relative to the illustration orientation) and may have a similar angle to the lower side (e.g., relative to the illustration orientation) of the inner surface of the slanted channel. In some implementations, having cam surfaces on the pin that have similar angles to the slanted channel (e.g., to allow the pin to slide in the slanted channel between an engaged and disengaged position).

The first cam surface 162 and/or the second cam surface 164 may extend along at least a portion of the pin length 166. In some implementations, a cam surface may be disposed in a recess of the pin. For example, the pin may include a first recess 161*a* in which the first cam surface is disposed such that the first cam surface is capable of contacting an inner surface of the slanted channel (e.g., a first side of the inner surface which may be farther away from the spring than the second side of the inner surface). The pin may include a second recess 161*b* in which a second cam surface is disposed such that the second cam surface is capable of contacting an inner surface of the slanted channel (e.g., a second opposing side of the inner surface which may be closer to the spring that the first side).

In some implementations, the first cam surface and/or the second cam surface may extend along the length of the pin. For example, the pin may have slanted sides. In some implementations, a second end of a pin may include a cap that extends from the pin and is capable of contacting a stop. The cap on the second end of the pin may extend from the pin in an approximately perpendicular direction relative to the stop. The pin may be disposed at a second angle relative to the cap on the second end of the pin. For example, the second angle may be between 0 and 90 degrees. In some implementations the second angle may be similar to the angle of the slanted channel (e.g., to allow the pin to slide in the channel between an engaged and disengaged position).

The pin may be disposed in at least two positions, a disengaged position and an engaged position. In the disengaged position, the first end 167 of the pin 160 may not be capable of contacting a stop 132 of the track 130 (e.g., since the pin may not extend or may not extend far enough away from the housing). The first end 167 of the pin 160 may contact and/or be proximate the second side 146 of the housing in the disengaged position. The second opposing end 168 of the pin may not contact the first side 145 of the housing in the disengaged position. In the engaged position, a first end 167 of the pin 160 may be capable of contacting a stop 132 of a track 130 in which the door 120 is disposed. A second opposing end 168 of the pin 160 may contact and/or be proximate the first side 145 of the housing in the engaged position.

The pin may be disposed in at least two positions, a disengaged position and an engaged position. In the disengaged position, the first end 167 of the pin 160 may not be capable of contacting a stop 134 of the track 130 (e.g., since the pin may not extend or may not extend far enough away from the housing). The first end 167 of the pin 160 may contact and/or be proximate the first side 145 of the housing in the disengaged position. The second opposing end 168 of the pin may not contact the first side 145 of the housing in the disengaged position. In the engaged position, a first end 167 of the pin 160 may be capable of contacting a stop 134 of a track 130 in which the door 120 is disposed. A second opposing end 168 of the pin 160 may contact and/or be proximate the second side 146 of the housing in the engaged position.

In some implementations, the safety brake may be disengaged to allow movement and adjustment of the height of the door. In a disengaged safety brake, the counterweight may exert a first force on the panel and pull the panel and thus exert a second force on the spring 170. The force exerted by the panel on the spring 170 due to the counterweight may stretch the spring from an initial position (e.g., a position in which the spring is not stretched or compressed). The force exerted on the panel by the counterweight may also act to retain the pin in the disengaged position. For example, the force exerted on the panel by the counterweight may exert (e.g., via a side of the slanted channel) a third force on the second cam surface 164 of the pin 160. The third force exerted on the second cam surface 164 of the pin 160 may cause the pin to slide towards the first side of the housing of the safety brake. The first end 167 of the pin 160 may thus extend from the first side 145 of the housing. The second end 168 of the pin 160 may contact or be disposed proximate the second side 146 of the housing by the third force exerted on the second cam surface 164 of the pin.

The counterweight exerts a force on the panel of the safety break which pulls the panel towards the first end of the housing of the safety brake and expands spring 170. When the movement fails and the counterweight is uncoupled (e.g., due to a broken cable) from the panel, the safety brake may be engaged. Since the force of the counterweight on the panel is removed (e.g., since the counter weight is uncoupled), and the force extending the spring is removed and the spring returns to an initial position (e.g., back to an unstretched position) and/or is compressed (e.g., by the weight of the panel). Thus, the panel is moved closer to the second end of the housing by the movement of the spring which is due to the uncoupling of the counterweight. When the panel moves closer to the second end of the housing, the panel (e.g., via side(s) of the slanted channel) exerts a fourth force on the first cam surface 162 to cause the pin to slide towards the second side 146 of the housing. The pin then extends from the second side of the housing to contact a stop on the track in which the door is disposed. Contact with a stop may inhibit further movement of the door (e.g., since the door may be inhibited from further falling by the stop).

The described processes may be implemented by various described systems, such as system 100. In addition, various operations may be added, deleted, and/or modified. In some implementations, process(es) or operations thereof may be performed in combination with other operation(s) and/or processes(es) and/or operations.

In some implementations, the pin may include a housing, as illustrated in FIG. 2D, and/or may not include a housing. The pin may include one or more caps to facilitate contact with stop(s) and/or to inhibit the pin from falling out of the slanted channel when forces are exerted on the panel (e.g., inhibit the pin from sliding out of the slanted channel when the safety brake is suddenly engaged or when the counterweight exerts a force on the panel). The cap may be a flange and/or protrusion extending from an end of the pin. As illustrated in some implementations, a second end 168 of a pin 160 may include a cap. In some implementations, a cap may not be included on the first end 167 of the pin 160 since the pin may not be inhibited from moving laterally (e.g., in the direction of the first axis 147) enough to fall out of the slanted channel due to the size of the housing. For example, the clearance between the panel and the housing may inhibit the pin from falling out of an end of the slanted channel.

In some implementations, the second end may not include a cap. For example, a part of the second end of the pin may contact (e.g., rather than a cap of a second end) the stop of the track.

The engagement of the safety brake may be automatic.

Although a movement member has been described, other movement members may be utilized. For example, the movement member illustrated in FIGS. 1A and 1B may represent a simplified movement member. Other movement members may be utilized as appropriate.

Although a single safety brake has been described. The vertical door may include more than one safety brake. For example, the door may include at least one safety brake coupled to the frame on each of two opposing sides of the door (e.g., sides that are disposed in the track). The safety brakes may work independently and/or in conjunction with each other.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a cam" includes a combination of two or more cams and reference to "a door" includes different types and/or combinations of doors. As another example, a reference to a pulley may include two or more pulleys and a reference to a "counterweight" may include different types and/or combinations of counterweights.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A safety brake comprising:

a housing comprising a first housing end and a second housing end;

a panel disposed in the housing and moveable within the housing, wherein the panel comprises:

a first panel end coupled to a counterweight;

an opposing second panel end, wherein the second panel end is disposed opposite to the first panel end;

a first panel side disposed between the first panel end and the second panel end;

a second panel-side disposed between the first panel end and the second panel end and disposed opposite the first panel side;

a slanted channel extending from the first panel side to the second panel side, wherein the channel is slanted relative to an axis perpendicular to the first panel side;

a coupling member capable of coupling to a vertical door;

a pin disposed at least partially in the slanted channel of the panel;

a spring comprising:

a first spring end coupled to the opposing second panel end; and a second opposing spring end coupled to the housing proximate the second housing end;

wherein when the counterweight is uncoupled from the panel the safety brake is configured to engage with a stop in a track in which the safety brake is disposed; and wherein when the counterweight is uncoupled from the panel, the spring compresses and causes the pin to extend further from the first panel side to engage the stop; and wherein engaging the stop in the track inhibits the vertical door coupled to the safety brake from falling.

2. The safety brake of claim 1 wherein the panel is coupled to the counterweight via a cable indirectly coupled to the panel.

3. The safety brake of claim 1 wherein the slanted channel extends upwards as the slanted channel extends from the first panel side to the second panel side of the panel.

4. The safety brake of claim 1 wherein at least one end of the pin comprises a head, wherein the head is capable of catching the pin on the stop of the track in which the safety brake is disposed.

5. The safety brake of claim 4 wherein the head comprises at least one of a cap, a flange, or a protrusion.

6. The safety brake of claim 1 wherein the pin comprises:

a length;

a first cam surface proximate a first pin end of the pin, wherein the first cam surface extends along at least a portion of the length of the pin; and a second cam surface proximate an opposing second pin end of the pin, wherein the opposing second pin end of the pin is disposed opposite to the first pin end of the pin; and wherein the second cam surface extends along at least a portion of the length of the pin.

7. The safety brake of claim 6 wherein an angle of at least a portion of the first cam surface and an angle of at least a portion of a first inner channel surface of the slanted channel are approximately complementary, and wherein an angle of at least a portion of the second cam surface and an angle of at least a portion of a second inner channel surface of the slanted channel are approximately complementary.

8. The safety brake of claim 6 wherein the first cam surface is disposed in a first recess of the pin such that the first cam surface is capable of contacting a first inner surface of the slanted channel, and wherein the second cam surface is disposed in a second recess of the pin such that the second cam surface is capable of contacting a second inner surface of the slanted channel.

9. The safety brake of claim 6 wherein the first cam surface and the second cam surface comprise slanted surfaces, wherein the slanted surfaces are slanted relative to an axis parallel to a length of the pin.

10. The safety brake of claim 6 wherein the track comprises a plurality of stops, and wherein the pin is inhibited from contacting the plurality of stops when the safety brake is disengaged.

11. The safety brake of claim 1 wherein the coupling member comprises an opening adapted to receive a door coupler, wherein the door coupler couples the vertical door to the safety brake.

12. A vertical door system comprising:

a door disposed on a track, wherein the track comprises one or more stops;

a movement including a counterweight, wherein the movement is coupled to the door and capable of adjusting a position of the door;

one or more safety brakes, wherein each of the safety brakes comprises:

a housing, wherein the housing comprises a first housing end and a second housing end, a panel disposed in the housing and moveable within the housing, wherein the panel comprises:

a first panel end coupled to the counterweight;

an opposing second panel end, wherein the opposing second panel end is disposed opposite to the first panel end;

a first panel side disposed between the first panel end and the second panel end;

a second panel side disposed between the first panel end and the second panel end and disposed opposite the first panel side;

a slanted channel extending from the first panel side to the second panel side, wherein the channel is slanted relative to an axis perpendicular to the first panel side;

a door coupler coupling the door and the panel;

a pin disposed at least partially in the slanted channel of the panel;

a spring comprising:

a first spring end coupled to the opposing second panel end; and a second opposing spring end coupled to the housing proximate the second housing end;

wherein each of the one or more safety brakes is configured to engage with at least one of the one or more stops in the track when the counterweight is uncoupled from the panel of the one or more safety brakes; and wherein when the counterweight is uncoupled from the panel of at least one of the safety brakes, the spring of the at least one of the safety brakes compresses and causes the pin of the at least one of the safety brakes to extend further from the first panel side of the panel of the at least one of the safety brakes and engage the at least one of the stops; and wherein said engaging the at least one of the stops in the track inhibits the door from falling.

13. The vertical door system of claim 12 wherein the movement operates automatically.

14. The vertical door system of claim 12 wherein the counterweight comprises more than one counterweight member.

15. The vertical door system of claim 12 wherein the door comprises at least one of a door panel or sub door.

16. A method of stopping a vertical door, the method comprising:

providing one or more safety brakes coupled to the vertical door, wherein the vertical door is disposed in a track, and wherein the track comprises one or more stops; and wherein each of the safety brakes comprises:

a panel moveable in a housing, wherein the panel comprises:

a first panel end coupled to a movement and proximate a first housing end of the housing, wherein the movement is coupled to the vertical door;

an opposing second panel end proximate a second housing end of the housing, wherein the opposing second panel end is opposite the first panel end;

a first panel side disposed between the first panel end and the second panel end;

a second panel side disposed between the first panel end and the second panel end and disposed opposite the first panel side;

a slanted channel extending from the first panel side to the second panel side, wherein the channel is slanted relative to an axis perpendicular to the first panel side;

a pin disposed in the channel, wherein the pin is disposed in the channel such that the pin does not contact the one or more stops in the track when the safety brake is disengaged, and wherein the pin is disposed in the channel such that the pin contacts at least one of the one or more stops when the safety brake is engaged; and a spring coupled between the second panel end and the second housing end;

automatically engaging at least one of the one or more safety brakes to inhibit the vertical door from falling when a counterweight of the movement of the at least one of the one or more safety brakes is uncoupled from the panel of the at least one of the one or more safety brakes; and wherein the uncoupling of the counterweight of the at least one of the one or more safety brakes from the panel of the at least one of the one or more safety brakes allows the spring of the at least one of the one or more safety brakes to compress and move the panel of the at least one of the one or more safety brakes towards the second housing end of the housing of the at least one of the one or more safety brakes which causes the pin in the panel of the at least one of the one or more safety brakes to extend such that the pin of the at least one of the one or more safety brakes is capable of contacting the at least one of the one or more stops in the track.

17. The method of claim 16 further comprising allowing adjustment of the vertical door when the one or more safety brakes are disengaged.

18. The method of claim 16 wherein the at least one of the one or more stops and the at least one of the one or more safety brakes are capable of supporting the door when the at least one of the one or more safety brakes is engaged.

19. The method of claim 16 wherein a pin head of the pin of the at least one of the one or more safety brakes contacts the at least one of the one or more stops in the track when the at least one of the one or more safety brakes is engaged.

* * * * *